United States Patent [19]

Nercessian

[11] 4,011,497

[45] Mar. 8, 1977

[54] VOLTAGE/CURRENT REGULATED POWER SUPPLY FOR VERY HIGH OUTPUT CURRENTS

[75] Inventor: Sarkis Nercessian, Flushing, N.Y.

[73] Assignee: Forbro Design Corporation, New York, N.Y.

[22] Filed: Dec. 10, 1975

[21] Appl. No.: 639,451

Related U.S. Application Data

[63] Continuation of Ser. No. 379,418, July 16, 1973, abandoned.

[52] U.S. Cl. ..... 323/4; 321/19; 323/8; 323/9; 323/20; 323/24; 323/25

[51] Int. Cl.[2] ..... G05F 1/50; G05F 1/58; G05F 1/60

[58] Field of Search ..... 321/18, 19, 20; 323/4, 323/8, 9, 20, 22 T, 23, 24, 25, 40

[56] References Cited

UNITED STATES PATENTS

| | | | |
|---|---|---|---|
| 3,124,698 | 3/1964 | Semmer et al. | 323/22 T |
| 3,152,296 | 10/1964 | Meszaros | 323/22 T |
| 3,305,763 | 2/1967 | Kupferberg | 323/9 |
| 3,353,080 | 11/1967 | Santelmann | 323/4 UX |
| 3,566,245 | 2/1971 | Blokker et al. | 321/19 X |
| 3,566,252 | 2/1971 | Nercessian | 323/40 X |

OTHER PUBLICATIONS

R. J. Klein, Dual Response Regulator, IBM TDB vol. 10, No. 8, Jan. 1968, pp. 1212, 1213.

*Primary Examiner*—A. D. Pellinen
*Attorney, Agent, or Firm*—Alfred W. Barber

[57] ABSTRACT

The power supply output is monitored by voltage and current mode amplifiers, which drive a shunt stabilizer according to control commands and load requirements, the shunt stabilizer altering its conduction, thereby compensating for any tendency of the output to change from its preset level. Simultaneously, the current through the shunt stabilizer is itself monitored by a control amplifier. Depending on the demands made on the shunt stabilizer (which in turn depends on the output requirements), the conduction angle of the control rectifiers in the silicon controlled rectifier phase control circuit are altered. The shunt stabilizer's current is thereby regulated. Two additional amplifiers are used to control the output current. One, the foldback amplifier, receives its input signals from the current mode amplifier and output terminals to transfer the power supply into foldback mode if an overload is present at the output terminals. The other, the limit amplifier determines the absolute maximum current which can be absorbed by the shunt stabilizer.

2 Claims, 5 Drawing Figures

VOLTAGE/CURRENT REGULATED POWER SUPPLY FOR VERY HIGH OUTPUT CURRENTS

This application is a continuation of Ser. No. 379,418, filed July 16, 1973, now abandoned.

Some of the basic concepts of the power supply are shown and described in the application entitled "Regulated Power Supply for Very High Currents" filed Mar. 22, 1973 and bearing Ser. No. 343,792, now abandoned. The present invention concerns additions and improvements to the above mentioned basic circuit.

The basic circuit employs a controllable source of dc current. This source is capable of providing current from a predetermined minimum up to the rated maximum load current plus this minimum current. This source of dc current is loaded with a fast programmable shunt stabilizer. The load is connected in shunt with the source and the programmable sink stabilizer. The shunt stabilizer is programmed by a voltage feedback control amplifier and a current feedback amplifier acting through an OR gate to provide what is known as a voltage/current cross-over power supply. The fast acting shunt stabilizer provides the fast programming and voltage or current regulation across the load. However, the shunt stabilizer operates over a predetermined range of stabilizing current and whenever the stabilizer current departs from a predetermined current, a feedback circuit controls the source to reestablish this predetermined current. Thus, the shunt stabilizer provides the fast and fine regulation of the load voltage and operates as a preload on the source to improve its operating characteristics while the source provides the main load current but need not be as fast acting or as finely controlled as is required for the voltage or current to the load.

SUMMARY

A number of significant improvements have been made over the original basic circuit shown and described in the above referenced application. Details of the improved main current source are also shown and described.

Figure 1:
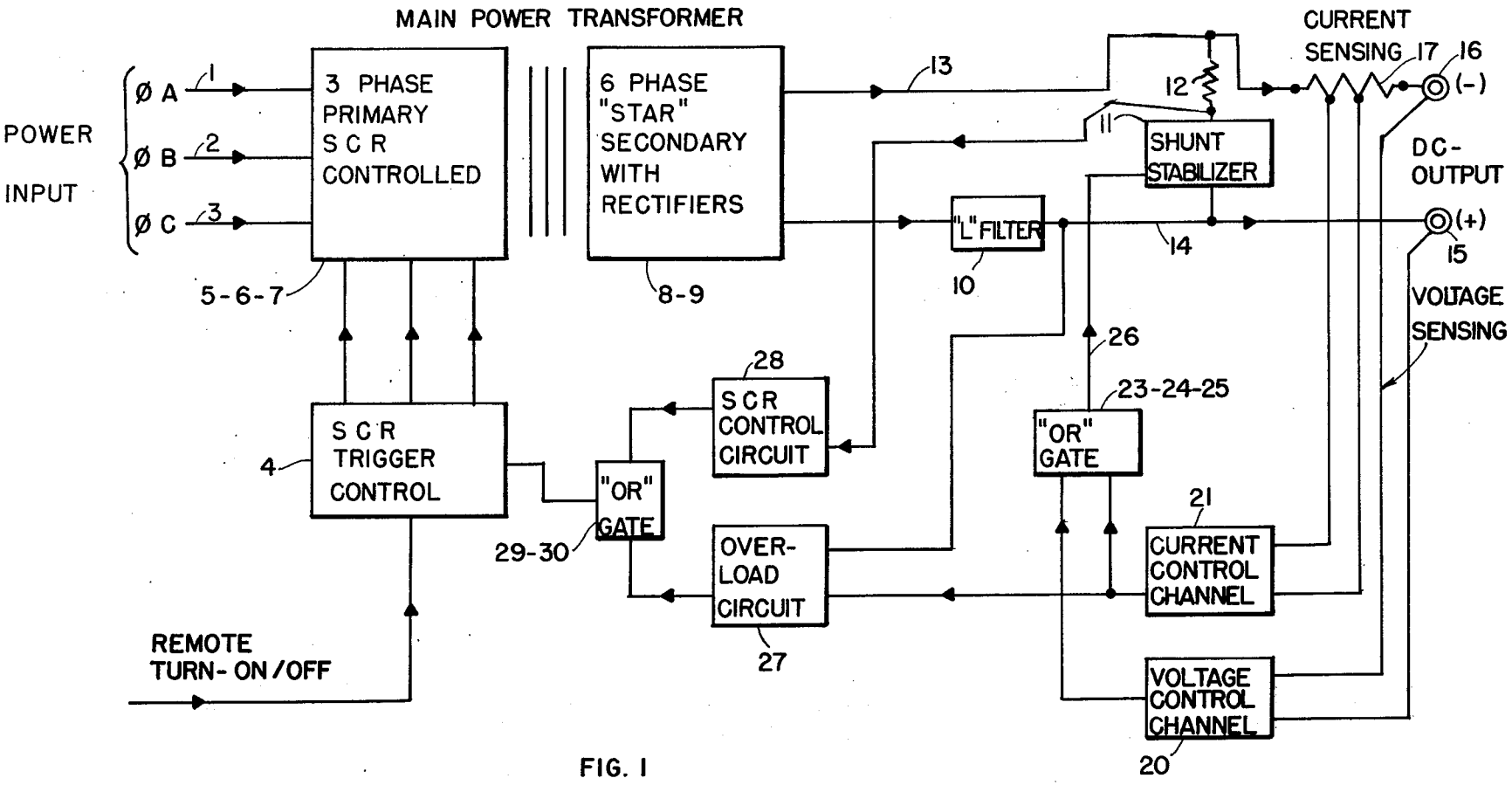
FIG. 1 is a greatly simplified block diagram of the essential circuits forming the present invention.

FIG. 1 while being a greatly simplified block diagram, does show the general organization of the invention. The power supply is connected to a three phase power input lines 1, 2 and 3. SCR trigger control 4 to silicon controlled rectifiers provide feedback controlled alternating current to primaries 5, 6 and 7 of transformer 5–8, the secondary 8 of which supplies ac voltage to rectifiers 9 (see FIG. 2 for further details). The rectified dc output from rectifiers 9 is applied through filter choke 10 to positive line 14 and directly to negative line 13. The positive output load terminal 15 is connected to positive line 14 while negative output load terminal 16 is connected to negative line 13 through output current sensing resistor 17.

Regulation and stabilization of the output voltage and current is provided by means of shunt stabilizer 11 and series connected current sensing resistor 12 (see FIG. 2) directly across lines 13 and 14. This shunt stabilizer is operated at a constant average current and provides fast and fine regulation of the output voltage and current. In order to maintain the average current through stabilizer 11 constant, a feedback control to the phase controlled silicon controlled rectifiers is provided by means of SCR control circuit 28 which obtains its input signal from current sensing resistor 12 and its output signal is applied through OR gate 29–30 to SCR trigger control 4.

The output voltage is controlled and regulated by means of voltage control amplifier 20 having its input signal obtained from the load terminals 15, 16 and its output signal applied through OR gate 23-24-25 to control line 26 of shunt stabilizer 11. The output current is controlled and regulated by means of current control amplifier 21 having its input signal obtained from current sensing resistor 17 (four terminal mode) and its output signal applied through OR gate 23-24-25 to the shunt stabilizer control line 26.

The basic circuits set forth up to this point have been disclosed, except for details of the phase controlled SCR's, in the copending application referenced above. The present application is mainly concerned with improvements which have been made in a number of details of the circuit of the present invention.

Figure 2:
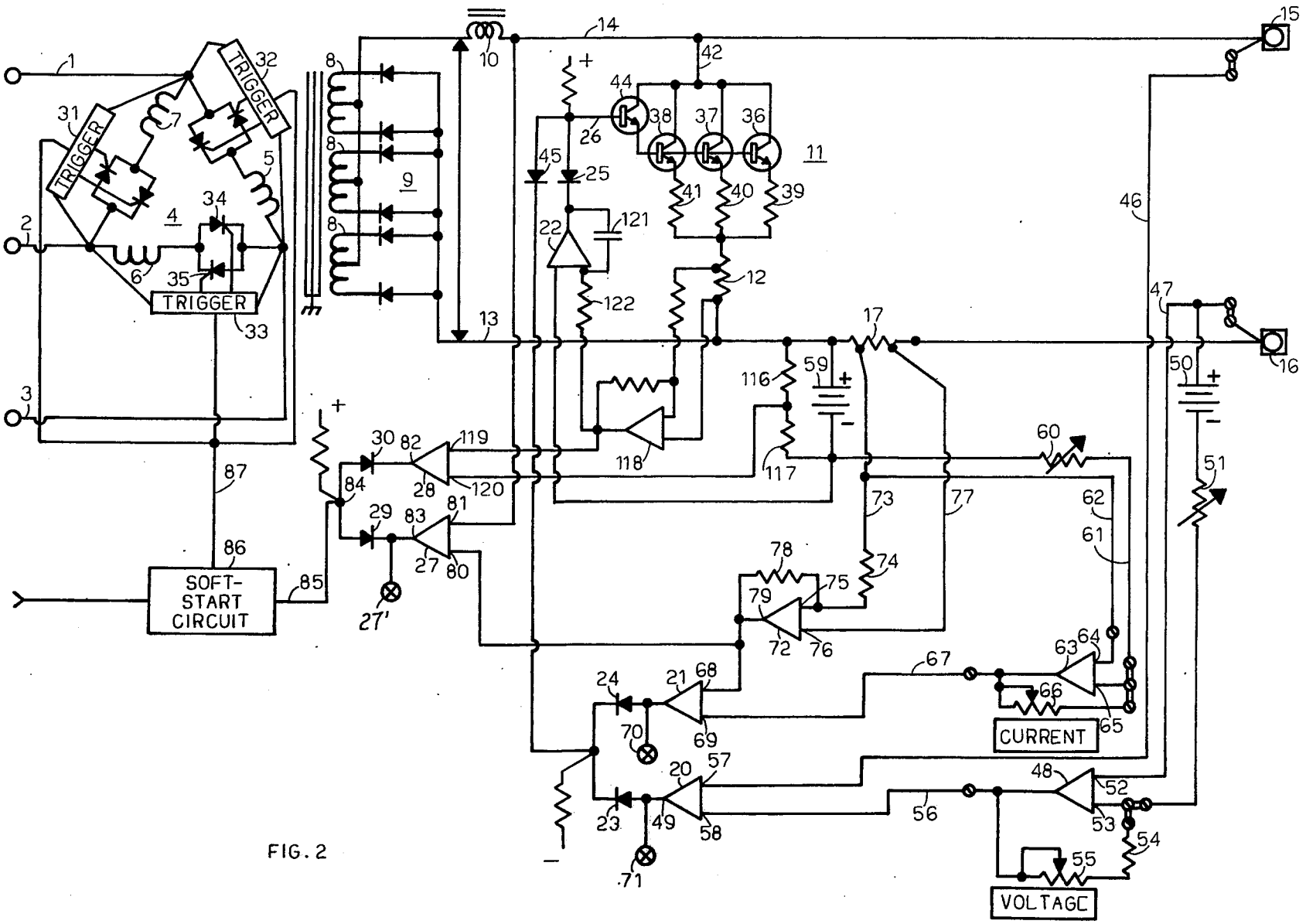
FIG. 2 is a schematic circuit diagram, partly in block form, of the present invention.

FIG. 2 is a schematic circuit diagram of the present invention showing additional details not provided in FIG. 1. For the sake of continuity in presentation, circuit elements corresponding to elements of FIG. 1 bear the same numbers. Shunt stabilizer 11 is now shown to be made up of three transistors, namely 36, 37 and 38 connected in parallel through current equalizing emitter resistors 39, 40 and 41, and driven by driver transistor 44. The collectors of all four transistors are connected together and over common lead 42 to positive line 14 while the emitter resistors are connected together at their outer ends and through shunt current sensing resistor 12 to negative line 13. In order to maintain constant current through the shunt stabilizer 11, the current induced voltage across shunt current sensing resistor 12 is amplified by preset gain operational amplifier 118 and the resulting voltage is applied to input terminal 119 of operational amplifier 28. Here it is compared with a portion of reference voltage 59 as determined by divider resistors 116 and 117 and applied to the other input 120. The output 82 is applied through gate diode 30, over lead 85, through soft start circuit 86 (described in more detail below) and over lead 87 to the inputs of trigger controls 31, 32 and 33 for controlling the alternating current input to the system so that the direct current through shunt current sensing resistor 12 is kept constant and hence, also, the current through shunt stabilizer 11.

Voltage and current regulation of the output are provided by operational amplifiers 20 and 21 as briefly set forth in connection with FIG. 1 above. First, considering details of the voltage regulation, voltage control amplifier 20 includes inputs 57 and 58. Input 57 is directly connected over lead 46 to positive output terminal 15. A direct comparison voltage is provided at input terminal 58 over lead 56 by a reference circuit comprising operational amplifier 48 havng input terminals 52 and 53; reference voltage source 50 (shown symbolically as a battery but in practice supplied by the voltage drop across a zener diode); input resistor 51 connected between voltage source 50 and input 53; and a feedback resistor including resistors 54 and 55 connected in series between output and input 53. Control of the output voltage is provided when the output of amplifier 20 actuates gate diode 23 and controls transistors 36-37-38 through driver 44. Resistor 51 is made variable for calibration purposes and resistor 55 is made variable for varying the output voltage by varying the reference voltage applied to amplifier 20. Resistor 54 determines the minimum output voltage in case it is desired not to go to zero output voltage. When the power supply is in voltage mode, the output voltage of amplifier 20 serves to energize the voltage mode indicator lamp 71.

Output current is controlled and regulated by operational amplifier 21 acting on driver 44 and hence transistors 36-37-38 through gate diode 24. Current mode operation is shown by current mode lamp 70 connected to the output of amplifier 21. The output current to terminals 15–16 is sensed by output current sensing resistor 17 and the resulting voltage drop is amplified by preset gain operational amplifier 72. The second voltage drop is applied over lead 77 to input 76 and over lead 73 and through input resistor 74 to input 75. The gain is equal to the value of feedback resistor 78 divided by the value of input resistor 74. The amplified voltage at output 79 is applied to one input 68 of operational amplifier 21. This voltage compared with an adjustable reference voltage provided by reference amplifier 63 on lead 67 and applied to the other input 69. This reference voltage is provided in a somewhat similar manner as the voltage reference. The voltage from reference voltage source 59 is applied through input resistor 60 and over lead 61 to input 65. Input 64 is returned to common line 13 over lead 62. The gain of amplifier 63 and hence the amplification of reference voltage 59 at the output of amplifier 63 is equal to the ratio of the value of feedback resistor 66 to input resistor 60. Resistor 66 is made adjustable as a means for varying the regulated output current of the power supply.

So far the means for keeping the current in the shunt stabilizer constant; the means for controlling the output volyage; and the means for controlling the output current have been described. In addition to these controls two overload protection circuits are provided; one for limiting the maximum current in the shunt stabilizer and the other providing fold-back of the output voltage in the event of a severe overload or short-circuit across the output terminals.

The maximum shunt stabilizer current is determined by means of operational amplifier 22. This amplifier compares the amplified current drop across shunt current sensing resistor 12 at the output of preset gain amplifier 118 with the voltage of voltage reference 59, each applied to one of the inputs of amplifier 22. When this amplified drop exceeds the reference 59, amplifier 22 controls driver 44 through gate diode 25. As a typical example, if the normal constant current through shunt stabilizer 11 is 60 amperes, the maximum overload current may be held to 100 amperes. However, in order to provide for a transient current of more than 100 amperes which can typically occur as a 300 ampere surge when the load is switched from 600 amperes to 300 amperes, the 100 ampere control is delayed. This delay is provided by input resistor 122 and feedback capacitor 121 which delays operation of amplifier 22 in the event of such a transient until capacitor 121 is charged through resistor 122 at which time the control returns the maximum current to the predetermined 100 ampere level. The diodes 25 and 45 form a gate whereby voltage or current control amplifiers 20–21 are normally in command but allowing overload amplifier 22 to take over during an overload condition as described above.

The output current is limited by a foldback circuit using amplifier 27 which compares the output current (as sensed across output current sensing resistor 17 and amplified by amplifier 72) with the output voltage. Amplifier 27 includes output terminal 83 and input terminals 80 and 81. The current sense input is applied to input terminal 80 and the output voltage from line 14 is applied to input 81. The output at terminal 83 is OR gated through gating diode 29 to junction 84 and thence over lead 85 to soft start circuit 86. At normal output voltages this circuit limits the output current to a predetermined value. However, when load impedances become very low or a short circuit exists across the output terminals, the voltage at input terminal 81 is reduced calling for a corresponding reduction in voltage at input terminal 80 and the output current is correspondingly reduced or folded back (see FIG. 3 below). Lamp 27' indicates when the foldback circuit is in control.

Figure 3:
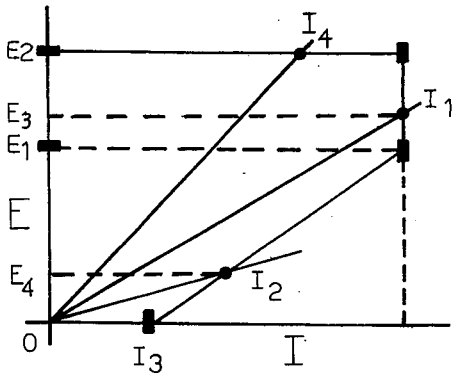
FIG. 3 is a graphical explanation of the various operating modes of the invention.

The diagram of FIG. 3 shows the voltage and current relationship of circuit described above for various load conditions across the output terminals. Voltage is indicated along the vertical axis and current along the horizontal axis. If the power supply is adjusted to provide an output voltage E2, a load across its terminal equal to $E_2/I_4$ will be represented by the load line $O\text{-}I_4$; a current equal to $I_4$ will be provided to the load. If the load impedance is reduced to $E_3/I_1$, the load line will be $O\text{-}I_1$, and the maximum current I, will flow through the load. If the load is reduced still further, say to $E_4/I_2$, the foldback circuit becomes effective and the current is reduced to $I_2$ as the output voltage reduces to $E_4$. Current $I_3$ represents the minimum foldback current at zero output voltage (short circuit) insuring self-starting of the control circuits once the short circuit is removed.

Figure 2A:
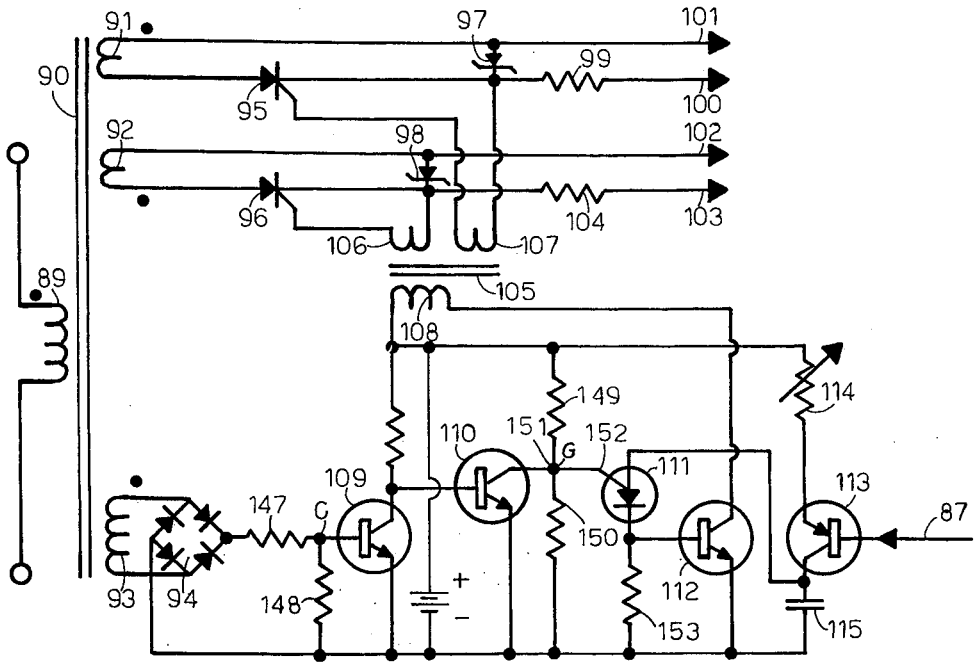
FIG. 2A is a detailed schematic circuit diagram of one of the SCR trigger circuits.
Figure 4:
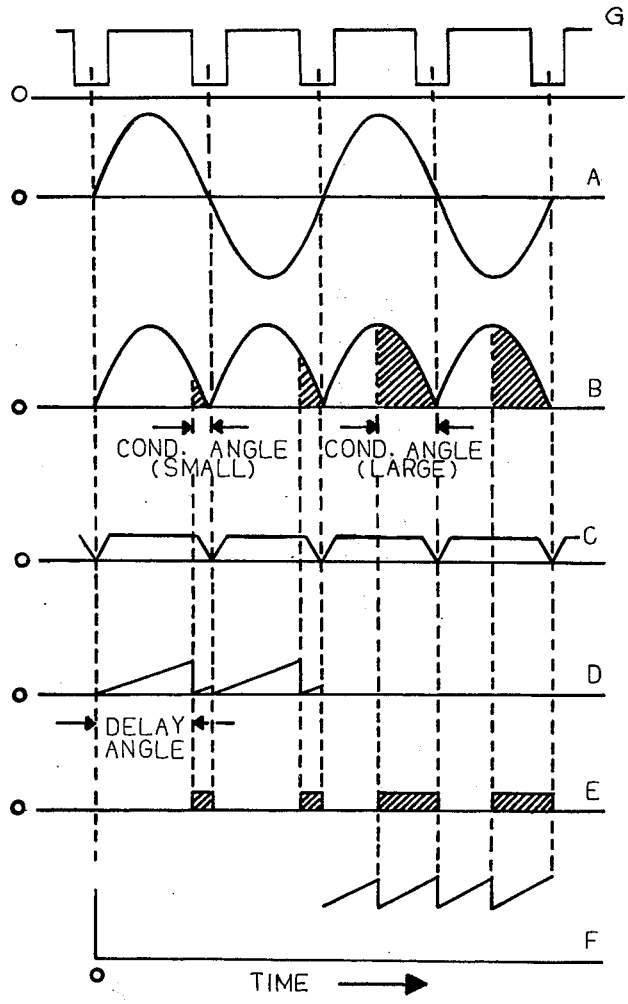
FIG. 4 is a graphical explanation of the timing and firing of the SCR's.

FIG. 2A is a detailed circuit diagram of one of the trigger circuits 31, 32 or 33 of FIG. 2. The explanation of this curcuit is aided by the waveform diagrams of FIG. 4. For each of the phases of the three phase input power, timing signals unique to that phase must be generated. The generation of a typical set of timing signals is illustrated in FIGS. 2A and 4. Alternating current from a given phase is applied to primary 89 of timing signal transformer 89-90-91-92-93 as illustrated by wave A of FIG. 4. The induced, in phase, secondary voltage across secondary 93 is rectified by full-wave bridge rectifier 94 providing full-wave signals like those shown at B in FIG. 4. This voltage is applied through voltage divider 147–148 to the input of transistor 109 providing a overdrive of this transistor and hence a square waveform at its output as shown at C, thus producing timing spikes. These timing spikes, amplified by transistor 110, are divided by voltage divider 149–150 at junction point 151 and are applied to gate 152 of programmable unijunction transistor 111 thereby timing the start of each ramp generated thereby as shown at D. The ramp voltage is provided by capacitor 115 charged at a constant rate by transistor 113 controlled by adjustable resistor 114. This rate may be modified by base input signals applied over lead 87 as set forth below. The unijunction transistor 111 thus synchronized to the phase to be controlled now provides ramp voltages as shown at D. When unijunction transistor 111 fires, it ends the ramp as is shown by the interval labedled "delay angle" and produces a conduction angle, small or large as the case may be as shown on curve B. The pulse generated when unijunction 111 fires appears across series resistor 153, is amplified by transistor 112 and is applied to primary 108 of pulse transformer 105-106-107-108. The purpose of the balance of the circuit is to generate firing pulses for the main silicon controlled rectifiers such as 34 and 35 of FIG. 2. This is accomplished by means of intermediate silicon controlled rectifiers 95 and 96 receiving oppositely phases alternating current from windings 91 and 92 respectively. When a pluse is received from the pulse transformer at secondaries 106 or 107 which ever of silicon controlled rectifiers is receiving a positive half cycle fires and remains on for the duration of that half cycle. The voltage pulse so produced is limited by the corresponding zener diode 97 or 98 to provide a substantially constant amplitude pulse as shwon at E through resistors 99 or 104 and at leads 100–101 or 102–103 as the case may be. These latter leads are the gate leads to the main silicon controlled rectifiers for example 34–35 of FIG. 2). Thus, the main silicon controlled rectifiers are provided with substantially square wave firing pulses. Such pulses are substantially more effective in insuring firing than are mere spikes as would come from a pulse transformer. This is due to the nature of the silicon controlled rectifier which may fire on a sharp pulse but will not hold if its output current does not have time to build to a holding value during the pulse. The holding current in the circuit of the present invention requires a substantial time to build due to choke 10 (FIG. 2) which causes the circuit to present a highly inductive load to the main silicon controlled rectifiers. Ramp voltages for large conduction angles are shown at F in FIG. 4.

As has been set forth above the main silicon controlled rectifiers are controlled to keep the average current in the shunt regulator constant. This control is exerted over lead 87 at the input to transistor 113 where it controls the charging rate of capacitor 115 and hence the slope of the ramp voltage and the resulting conduction angle of the main silicon controlled rectifiers. Over-riding controlis also applied here including the current limiting foldback control as described above in connection with FIGS. 1 and 2. A soft-start in order to protect the power circuits in case of remanence in the transformer after turn-off, is provided on turn-on by providing a delay in the signals on line 87 at start-up.

I claim:

1. In a regulated DC power supply, the combination of;

a controllable source of DC current;

a pair of load terminals connected through a first current sensing resistor across said source;

a controllable shunt current stabilizer connected in series with a second current sensing resistor and across said source;

means for keeping the current in said current stabilizer constant including feedback control means connected between said second current sensing resistor and said controllable source of DC current;

means for controlling the current in said current stabilizer for programming the voltage and current to said load terminals including voltage and current feedback means, adjustable current and voltage reference voltage means and current and voltage control amplifier means;

and including means for limiting the current in said shunt current stabilizer and a time delay means for delaying the limiting action of said last said means for a predetermined time interval.

2. In a regulated DC power supply, the combination of;

a controllable source of DC current;

a pair of load terminals connected through a first current sensing resistor across said source;

a controllable shunt current stabilizer connected in series with a second current sensing resistor and across said source;

means for keeping the current in said current stabilizer constant including feedback control means connected between said second current sensing resistor and said controllable source of DC current;

means for controlling the current in said current stabilizer for varying the voltage and current to said load terminals over a wide range of values including voltage and current feedback means, adjustable currrent and voltage reference voltage means and current and voltage control amplifier means;

wherein said current feedback means includes said first current sensing resistor;

and including means for limiting the maximum current in said current stabilizer to a predetermined value;

and a time delay means for delaying the limiting action of said limiting means for a predetermined time interval;

whereby during the time delay interval currents greater than said predetermined value are permitted to flow in said current stabilizer.

* * * * *